US006004712A

United States Patent [19]

Barbetta et al.

[11] Patent Number: 6,004,712

[45] Date of Patent: Dec. 21, 1999

[54] COATED CARRIER

[75] Inventors: Angelo J. Barbetta, Penfield; Robert D. Bayley, Fairport; Carol A. Fox, Canandaigua; Thomas R. Hoffend, Webster; John G. VanDusen, Walworth; Scott M. Silence, Fairport; K. Derek Henderson, Rochester, all of N.Y.

[73] Assignee: Xerox Corporation, Stamford, Conn.

[21] Appl. No.: 09/140,594

[22] Filed: Aug. 26, 1998

[51] Int. Cl.[6] ..... G03G 9/113

[52] U.S. Cl. ..... 430/108; 430/97

[58] Field of Search ..... 430/108, 106.6, 430/137, 97

[56] References Cited

U.S. PATENT DOCUMENTS

| | | | |
|---|---|---|---|
| 3,533,835 | 10/1970 | Hagenbach et al. | 117/217 |
| 3,590,000 | 6/1971 | Palermiti et al. | 252/62.1 |
| 3,658,500 | 4/1972 | Hagenbach | 65/21 |
| 3,798,167 | 3/1974 | Kukla et al. | 252/62.1 |
| 3,918,968 | 11/1975 | Kukla et al. | 96/1.5 D |
| 3,922,382 | 11/1975 | Kukla et al. | 427/58 |
| 3,939,086 | 2/1976 | Hagenbach | 252/62.1 P |
| 4,020,192 | 4/1977 | Nozaki | 430/108 |
| 4,233,387 | 11/1980 | Mammino et al. | 430/137 |
| 4,238,558 | 12/1980 | Ziolo | 430/108 |
| 4,264,697 | 4/1981 | Perez et al. | 430/107 |
| 4,298,672 | 11/1981 | Lu | 430/108 |
| 4,310,611 | 1/1982 | Miskinis | 430/107 |
| 4,338,390 | 7/1982 | Lu | 430/106 |
| 4,397,935 | 8/1983 | Ciccarelli et al. | 430/110 |
| 4,434,220 | 2/1984 | Abbott et al. | 430/108 |
| 4,560,635 | 12/1985 | Hoffend et al. | 430/106.6 |
| 4,810,611 | 3/1989 | Ziolo et al. | 430/106.6 |
| 4,935,326 | 6/1990 | Creatura et al. | 430/108 |
| 4,937,166 | 6/1990 | Creatura et al. | 430/108 |
| 5,376,494 | 12/1994 | Mahabadi et al. | 430/137 |
| 5,744,275 | 4/1998 | Duggan et al. | 430/108 |

FOREIGN PATENT DOCUMENTS

| | | |
|---|---|---|
| 63-226661 | 9/1988 | Japan . |
| 10-73968 | 3/1998 | Japan . |

OTHER PUBLICATIONS

Chemical Abstracts 128:302077, Mar. 1998.

Chemical Abstracts 110:222557, Sep. 1988.

Diamond, Arthur S. Handbook of Imaging Materials. New York: Marcel–Dekker, Inc. p. 215, 1991.

*Primary Examiner*—Christopher D. Rodee

*Attorney, Agent, or Firm*—E. O. Palazzo

[57] ABSTRACT

A carrier comprised of a core and thereover a polymer of (1) methylmethacrylate and a monoalkyl aminoalkyl methacrylate, or (2) a polymer of methylmethacrylate and dialkylaminoalkyl methacrylate.

29 Claims, No Drawings

COATED CARRIER

PENDING APPLICATIONS

Illustrated in U.S. Pat. No. 5,945,244; U.S. Ser. No. 09/140,524; U.S. Ser. No. 09/140,439; and U.S. Pat. No. 5,935,750; all filed concurrently herewith, and the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in U.S. Pat. No. 5,945,244 a carrier comprised of a core, and thereover a polymer of styrene, an olefin and a dialkylaminoalkyl methacrylate; in copending application U.S. Ser. No. 09/140,524 a carrier composition comprised of a core and thereover a polymer of (1) polystyrene/alkyl methacrylate/dialkylaminoethyl methacrylate, (2) polystyrene/alkyl methacrylatealkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; in copending application U.S. Ser. No. 09/140,439 a carrier comprised of a core and a polymer coating of (1) styrene/monoalkylaminoalkyl methacrylate or (2) styrene/dialkylaminoalkyl methacrylate; and in U.S. Pat. No. 5,935,750 a carrier comprised of a core and a polymer coating containing a quaternary ammonium salt functionality.

The appropriate components and processes of the above recited copending applications may be selected for the present invention in embodiments thereof.

BACKGROUND OF THE INVENTION

This invention is generally directed to developer compositions, and more specifically, the present invention relates to developer compositions with coated carrier components, or coated carrier particles that can be prepared by, for example, dry powder processes. More specifically, the present invention relates to compositions, especially carrier compositions comprised of a core, and thereover copolymers of methylmethacrylate and a mono or dialkylaminoalkyl methacrylate.

In embodiments of the present invention, the carrier particles are comprised of a core with a coating thereover of copolymers of methylmethacrylate and dimethylaminoethyl methacrylate, methylmethacrylate copolymers with substituted alkyl aminoethyl methacrylate, butylaminoethyl methacrylate, and the like. The carrier may include the polymer coating thereover in admixture with other suitable polymers, and more specifically, with a second polymer, such as a fluoropolymer, polymethylmethacrylate, poly(urethane), especially a crosslinked polyurethane, such as a poly(urethane)polyester and the like, and moreover, the copolymer coating may contain a conductive component, such as carbon black, and which conductive component is preferably dispersed in the polymer coating. With the conductive component, there can be enabled carriers with increased developer triboelectric response at relative humidities of from about 20 to about 90 percent, improved image quality performance, excellent high conductivity ranges of from about $10^{-10}$ to about $10^{-7}$ (ohm-cm)$^{-1}$, and the like. An important advantage associated with the carriers of the present invention with the polymer coatings thereover include a high triboelectrical charge, for example a carrier tribo range of from about a plus (positive charge) 50 to about 150, or to about 95 microcoulombs per gram, and preferably from about a positive 55 to about a positive 90 microcoulombs per gram, and most preferably from about a positive 60 to about a positive 70 microcoulombs per gram. The carrier particles of the present invention can be selected for a number of different imaging systems and devices, such as xerographic copiers and printers, inclusive of high speed color xerographic systems, printers, digital systems, combination of xerographic and digital systems, and wherein colored images with excellent and substantially no background deposits are achievable. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected, which charge is dependent, for example, on the polymer composition and dispersant component applied to the carrier core, and optionally the type and amount of the conductive component selected.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith, especially at a variety of relative humidities.

Carrier particles for use in the development of electrostatic latent images are described in many patents including, for example, U.S. Pat. No. 3,590,000, the disclosure of which is totally incorporated herein by reference. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where a portion of, or the entire coating may separate from the carrier core in the form of, for example, chips or flakes, and which resulting carrier can fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low triboelectrical values.

There is illustrated in U.S. Pat. No. 4,233,387, the disclosure of which is totally incorporated herein by reference, coated carrier components comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. The appropriate components and processes of the '166 and '326 patents may be selected for the present invention in embodiments thereof. The present invention has the advantage over this prior art of achieving high positive triboelectric charge on the carrier particles, that is high, up to about 150 negative triboelectric charge is imparted to the toner particles developed onto a photoreceptor in, for example, a xerographic development environment. Further, the full range of electrical properties of the carrier particles can be achieved at high triboelectric charging values, from carrier conductivities of $10^{-17}$ mho/cm to $10^{-6}$ mho/cm, that is, from the insulative to the conductive regime, and the carrier triboelectric charge and carrier conductivity can be varied and preselected.

With further reference to the prior art, carriers obtained by applying insulating resinous coatings to porous metallic carrier cores using solution coating techniques are undesirable from many viewpoints. For example, the coating can reside primarily in some of the pores of the carrier cores, rather than at the surfaces thereof; and therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves processing excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome or minimize these disadvantages, and further enable developers that are capable of generating high triboelectric charging values with finely divided toner particles; and also wherein the carrier particles in embodiments are of substantially constant conductivity.

When resin coated carrier particles are prepared by powder coating process the majority of the coating materials are fused to the carrier surface thereby reducing the number of toner impaction sites on the carrier. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities as determined in a magnetic brush conducting cell of from about $10^{-6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, and high carrier triboelectric charging values of from about 20 to about 150, and, for example, from a positive about 45 to a positive about 90, microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles.

Other U.S. Patents that may be of interest include U.S. Pat. No. 3,939,086, which illustrates steel carrier beads with polyethylene coatings, see column 6; U.S. Pat. Nos. 4,264,697; 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is an feature of the present invention to provide toner and developer compositions with carrier particles containing polymer coatings.

In another feature of the present invention there are provided dry coating processes for generating carrier particles of substantially constant conductivity parameters.

In yet another feature of the present invention there are provided dry coating processes for generating carrier particles of substantially constant conductivity parameters, and high triboelectric charging values.

In yet a further feature of the present invention there are provided carrier particles with high tribo values of at least about 50 microcoulombs per gram, and wherein the carrier includes thereover a copolymer, or a coating of two polymers wherein the second polymer is a copolymer of polymethylmethacrylate, and poly(urethane), and wherein the coating may contain therein a conductive component of, for example, carbon black.

Aspects of the present invention relate to a carrier comprised of a core and thereover a polymer inclusive of polymers of (1) methylmethacrylate and a monoalkyl aminoalkyl methacrylate, or (2) a polymer inclusive of polymers of methylmethacrylate and dialkylaminoalkyl methacrylate; a carrier wherein each of said polymer alkyl independently contains from 1 to about 25 carbon atoms, and said polymer is comprised of polymers; a carrier wherein each of said alkyl independently contains from 1 to about 6 carbon atoms; a carrier wherein the polymer coating is a copolymer of methylmethacrylate and dimethylaminoethyl methacrylate, or a copolymer of methylmethacrylate and a monoalkylaminoalkyl methacrylate; a carrier wherein the polymer coating is a copolymer of methylmethacrylate and a dialkylaminoalkyl methacrylate; a carrier wherein the copolymer coating is dimethylaminoethyl methacrylate/methylmethacrylate, or methylmethacrylate copolymers with substituted alkyl aminoethyl methacrylates; a carrier wherein the copolymer coating contains from about 60 to 95 weight percent of methylmethacrylate, and from about 5 to 40 weight percent of dialkylaminoalkyl methacrylate; a carrier wherein the copolymer coating possesses an $M_w$ of form about 20,000 to about 900,000, and of an $M_n$ of from about 12,000 to about 350,000; a carrier wherein the polymer coating is a copolymer and the coating weight thereof is from about 0.1 to about 20 weight percent; a carrier wherein the polymer coating weight is from about 1 to about 3 weight percent; a carrier wherein the polymer coating contains a conductive component; a carrier wherein the conductive component is a metal oxide, or is carbon black; a carrier wherein the conductive component is carbon black selected in an amount of from about 10 to about 60 weight percent; a carrier wherein the core is a metal, a metal oxide, or a ferrite; a carrier with a triboelectric charge of from about a positive 50 to about a positive 150 microcoulombs per gram; a carrier with a triboelectric charge of from about a positive 50 to about a positive 70 microcoulombs per gram; a developer comprised of a coated carrier and toner; a developer wherein the toner is comprised of thermoplastic resin and colorant; a developer wherein the colorant is a pigment and the toner resin is a styrene copolymer, or a polyester; a developer comprised of a (1) carrier core and coating layer of a copolymer or copolymers of methylmethacrylate and a dialkylaminoalkyl methacrylate, and (2) a toner; a developer wherein the carrier core is selected from the group consisting of iron, ferrites, steel and nickel; a developer with a carrier triboelectric charge of from about a positive 50 to about a positive 150 microcoulombs per gram, and a toner triboelectric charge of from about a negative 50 to about a negative 150 microcoulombs per gram; a developer with a carrier triboelectric charge of from about a positive 60 to about a positive 70 microcoulombs per gram, and a toner triboelectric charge of from about a negative 60 to about a negative 70 microcoulombs per gram; a carrier wherein the polymer coating is a copolymer of methylmethacrylate/dimethylaminoethyl methacrylate; a copolymer of methylmethacrylate and tertiary-butylaminoethyl methacrylate; a copolymer of methylmethacrylate and diethylaminoethyl methacrylate; a copolymer of methylmethacrylate and diisopropylaminoethyl methacrylate; or a copolymer of methylmethacrylate and an alkylaminoethyl methacrylate; a carrier wherein the carrier contains a second polymer coating; a carrier wherein the second coating is comprised of a styrene acrylate, a styrene methacrylate, or a fluoropolymer; a carrier wherein said second coating is comprised of a polyurethane and which polyurethane optionally contains dispersed therein conductive components; a carrier wherein the second coating is comprised of a polyurethane/polyester with carbon black optionally dispersed therein; a carrier comprised of a core, and thereover a polymer or polymers of alkylmethacrylate and alkylaminoalkyl methacrylate; and a carrier wherein said substituted alkyl aminoethyl methacrylate is a tertiary-butylaminoethyl methacrylate; a carrier comprised of a core, and a coating of polymers of alkylmethacrylate and an alkylaminoalkyl methacrylate.

The present invention is directed to, for example, developer compositions comprised of toner particles, and carrier particles prepared, for example, by a powder coating process, and wherein the carrier particles are comprised of a core with certain coatings thereover; carrier particles prepared by mixing low density porous magnetic, or magnetically attractable metal core carrier particles with from, for example, between about 0.05 percent and about 3 percent by weight, based on the weight of the coated carrier particles, of certain polymers, and which polymer may optionally contain dispersed therein carbon black or a similar conductive component, until adherence thereof to the carrier core by mechanical impaction or electrostatic attraction; heating the resulting mixture of carrier core particles and polymer to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

Specifically, the present invention relates to a composition comprised of a core, and thereover a nitrogen-containing copolymer present in an amount of from about 0.05 to about 3 weight percent of the total carrier composition, and which copolymer may optionally contain a conductive component, such as a metal oxide, or a pigment like preferably carbon black, wherein the conductive component is selected, for example, in an amount of from about 10 to about 75 weight percent, and preferably from about 15 to 50 weight percent, based on the sum of the nitrogen-containing polymer and conductive component; a carrier with two polymers thereover, wherein the first polymer is a nitrogen-containing copolymer and wherein the conductive component for either the first or second polymer is a metal oxide, or a pigment selected in an amount of from about 10 to about 50 weight percent; and wherein the second polymer is as illustrated herein, that is for example, a fluorocarbon, polymethylmethacrylate (PMMA), a thermosetting polymer, such as a thermosetting polyurethane, a polyester, a styrene based polymer, or second a nitrogen-containing copolymer, and wherein the first polymer is selected in an amount of from about 1 to about 100, or from about 10 to about 75 weight percent, based on the total weights of all polymers and conductive components present in the carrier and the second polymer is selected in an amount of from about 99 to about 0, or from about 90 to about 25 weight percent, based on the total weights of all polymers and conductive components present in the carrier; and wherein the carrier core is a metal, a ferrite, a metal oxide, and the like, inclusive of known carrier cores. Also, in embodiments there are provided carriers with coatings of amine copolymers, a mixture of amine copolymers with other polymers, and especially a mixture of a first amine copolymer and a second polymer, such as PMMA, a thermosetting polyurethane, and the like inclusive of suitable known polymers.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also of importance with regard to the carrier core properties are, for example, suitable magnetic characteristics that will permit magnetic brush formation in magnetic brush development processes; and also wherein the carrier cores possess desirable mechanical aging characteristics; and further, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide and available from D.M. Steward Corporation or Powdertech Corporation, Ni/Zn-ferrite available from Powdertech Corporation, Sr (strontium)-ferrite, containing, for example, about 14 percent strontium oxide and 86 percent iron oxide and available from Powdertech Corporation Ba-ferrite, magnetites, available, for example, from Hoeganaes Corporation (Sweden), nickel, mixtures thereof, and the like. Preferred carrier cores include ferrites, and sponge iron, or steel grit with an average particle size diameter of, for example, from between about 30 microns to about 400 microns, and preferably from about 50 to about 50 microns.

Examples of polymers selected for the carrier include copolymers of methylmethacrylate or methylacrylate and a monoalkyl, or dialkyl amine, such as a dimethylaminoethyl methacrylate, diethylaminoethyl methacrylate, diisopropylaminoethyl methacrylate, or t-butylaminoethyl methacrylate; and the like. Specific examples of copolymer coatings are poly(methylmethacrylate/dimethylaminoethyl methacrylate), poly(methylmethacrylate/tertiary-butylaminoethyl methacrylate), poly(methylmethacrylate/diethylaminoethyl methacrylate), poly(methylmethacrylate/diisopropylaminoethyl methacrylate), copolymers of methylmethacrylate with other monoalkyl or dialkylaminoethyl methacrylates, wherein alkyl contains, for example, from about 1 to about 25, and preferably from 1 to about 10 carbon atoms, such as methyl, ethyl, propyl, butyl, pentyl, hexyl, octyl, nonyl, and the like.

The monomers for synthesizing the above polymers can be obtained from a number of sources, such as Aldrich Chemical Company with respect to styrene, dimethylaminoethyl methacrylate, diethyl aminoethyl methacrylate, and methylmethacrylate, and for example, Scientific Polymer Products with regard to diisopropylaminoethyl methacrylate and t-butylaminoethyl methacrylate. Synthetic methods for the preparation of polymers and copolymers from these monomers may be by bulk polymerization, solution polymerization, emulsion polymerization, suspension or semisuspension polymerization or any other known suitable polymerization methods.

The carrier polymer coatings can thus be prepared by bulk polymerization which can be accomplished with monomers in the absence of solvent, and by solution polymerization can be effected in a solvent medium, such as toluene, in which the monomer or mixture of monomers is combined with a suitable initiator, such as 2,2'-azobis(2-methylpropionitrile), referred to as AIBN, and reacted for an effective period of time, for example from about 7 to about 15, and preferably about 11 hours, at an elevated temperature, for example about 70° C. to about 90° C. From this reaction, a solution with a solids content of, for example, about 22.7 percent by weight polymer can be obtained, and wherein the polymer has a glass transition of about 108° C., and molecular weight by gel permeation chromatography of $M_w$=about 90,000 with molecular weight dispersibility, that is the ratio of $M_w/M_n$, or MWD=of about 2.3.

Suspension polymerization methods involve mixing monomers and initiator, such as AIBN, to obtain a clear organic phase. The organic phase is then combined with an aqueous solution of Air Products Airvol 603 Polyvinyl Alcohol, and a potassium iodide aqueous phase inhibitor. The desired particle size can be obtained by homogenizing the two phases with a Brinkman homogenizer equipped with a Polytron Generator with three stationary and three moving rings of flat rotor design for about five minutes at about 8,000 RPM. The resulting suspended organic phase is then transferred to the preheated reactor and stirred at about 65 RPM to maintain stability of the suspension, maintained at 70° C. for 6 hours and 40 minutes to complete polymerization, cooled, removed from the reactor, washed and centrifuged 5 times with a 90/10 volume ratio of methanol/water, and finally washed with water only. The wet polymer suspension is then air dried, placed in a vacuum oven at from about 40.0° C. to 80.0° C. to complete drying, and further broken down to its primary particle size by ball milling followed by screen sieving. This process yields a polymer particle size having a volume median of, for example, about 4.0$\mu$, a second pass glass transition onset temperature of 95.8° C., and a molecular weight $M_w$ by gel permeation chromatography of about 520,000 with an about MWD of about 2.2.

Emulsion polymerization can be accomplished by the continuous addition to a suitable reaction vessel containing water, and providing mechanical stirring, a nitrogen atmosphere, and thermostatic control, a mixture of monomers and an initiator, such as ammonium persulfate initiator, as obtained from Aldrich Chemical Company (0.2 to 0.6 percent by weight of monomers). The polymerization can be effected by heating to, for example, between about 55 and about 65° C. to achieve polymer molecular weights, $M_w$ by gel permeation chromatography ranging from, for example, about 200,000 to about 900,000. The polymer or copolymer powder is isolated by freeze drying in vacuo, the residue free latex, and the resulting polymer particle diameter size is, for example, about 0.1 to about 2.0 microns in volume average diameter.

The carrier polymer coating preferably has dispersed therein in embodiments conductive components, such as metal oxides like tin oxide, conductive carbon blacks, and the like, in effective amounts of, for example, from about 0 to about 70 and preferably from about 15 to about 60 weight percent. Specific examples of conductive components include the conductive carbon black SC Ultra available from Conductex, Inc., and antimony-doped tin oxide Zelec ECP3005-XC manufactured by E.I. DuPont.

The process for incorporating the polymer onto a carrier core can be sequential, a process in which one of the two polymers, when two polymers are selected, is fused to the surface in a first step and the second polymer is fused to the surface in a subsequent fusing operation. Alternatively, the process for incorporation can comprise a single fusing.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, and the like, including those as illustrated in a number of the patents recited herein, and other effective known charge agents or additives. The charge additives are selected in various effective amounts, such as from about 0.05 to about 15, and from about 0.1 to about 3 weight percent, based, for example, on the sum of the weights of polymer, conductive additive, and charge additive components. The addition of various known charge enhancing additives can act to further increase the triboelectric charge imparted to the carrier, and therefore, further increase the negative triboelectric charge imparted to the toner in, for example, a xerographic development subsystem.

Examples of second polymers selected can include polymonoalkyl or dialkyl methacrylates or acrylates, polyurethanes, fluorocarbon polymers such as polyvinylidenefluoride, polyvinylfluoride, and polypentafluorostyrene, polyethylene, polyethylene-co-vinylacetate, polyvinylidenefluoride-co-tetrafluoroethylene, and the like, inclusive of other known suitable polymers. Other known related polymers not specifically mentioned herein may also be selected, such as those illustrated in the U.S. Pat. Nos. 4,937,166 and 4,935,326 patents mentioned herein.

A specific second polymer is comprised of a thermosetting polymer and yet, more specifically, a poly(urethane) thermosetting resin which contains, for example, from about 75 to about 95, and preferably about 80 percent by weight of a polyester polymer, which when combined with an appropriate crosslinking agent, such as isopherone diisocyannate and initiator such as dibutyl tin dilaurate forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first copolymer polymer, generally prior to mixing with the core, which when fused forms a uniform coating of the first and second polymers on the carrier surface. The second polymer is present in an amount of from about 0 percent to about 99 percent by weight, based on the total weight of the first and second polymers and the conductive component in the first polymer.

The advantages of the carriers of the present invention include in embodiments high robust carrier tribo charge of a positive value, high toner tribo charge of a negative value, excellent admix, for example from about 1 to about 30 seconds as determined in the charge spectrograph, and the like. More specifically, the toner tribo can be, for example, from about a minus 50 to about a minus 150, from about a minus 55 to about a minus 90, or from about a minus 60 to about a minus 85, with corresponding positive tribo charges for the carrier increased resistance of the carrier to mechanical aging in a xerographic environment and a decreased sensitivity of the carrier triboelectric value to the relative humidity of the environment. The tribo can be determined by a number of known methods, such as the use of a Faraday Cage. With respect to high toner tribo charge of a negative value, this property is important to xerographic, especially color applications, primarily because there is enabled development of toner particles into regions of the imaging member, such as a photoreceptor where strong fringe electrical fields exist, that is, at the borders of solids areas and lines. Developing toner particles through these fringe fields minimizes or eliminates the untoned part of the image which appears between two adjacent colors in an image.

Various effective suitable processes can be selected to apply the polymer, or mixture, for example from 2 to about 5, and preferably two, of polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders, include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins, such as ethylene, propylene, butylene and isobutylene; vinyl halides, such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments dyes, or mixtures thereof, and preferably pigments can be selected as the colorant for the toner particles including, for example, carbon black, nigrosine dye, lamp black, iron oxides, magnetites, and mixtures thereof, known cyan, magenta, yellow pigments, and dyes. The colorant, which is preferably carbon black, should be present in a sufficient amount to render the toner composition highly colored. Thus, the colorant can be present in amounts of, for example, from about 1 percent by weight to about 20, and preferably from about 5 to about 12 percent by weight, based on the total weight of the toner components, however, lesser or greater amounts of colorant may be selected. Illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, Pigment Blue 15:3, and the like. Examples of cyans that may be used include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5dimethoxy acetoacetanilide, permanent yellow FGL, and the like. Other known suitable colorants, such as reds, blues, browns, greens, oranges, and the like, inclusive of dyes thereof can be selected. These colorants are generally present in the toner composition in an amount of from about 1 weight percent to about 15, and, for example, from about 2 to about 12 weight percent based on the weight of the toner components of binder and colorant.

When the colorant particles are comprised of magnetites, which are a mixture of iron oxides ($FeO \bullet Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and, for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the colorant are spray dried under controlled conditions to result in the desired product. Toner particles sizes and shapes are known and include, for example, a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990, 4,585,884, 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with the developer compositions of the present invention in embodiments possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following Examples are being provided to further define the present invention, it being noted that these Examples are intended to illustrate and not limit the scope of the present invention. Parts and percentages are by weight unless otherwise indicated.

SYNTHETIC EXAMPLE I

Synthesis of a 85/15 weight percent copolymer, poly (methylmethacrylate-co-dimethylaminoethyl methacrylate) as follows:

A 2.5 liter jacketed glass reactor was fitted with a stainless steel stirrer, thermal couple temperature probe, water cooled condenser with nitrogen outlet, a nitrogen inlet, and heated with hot, about 75° C., water circulating bath. The toluene and monomers were passed through a column of basic aluminum oxide to remove inhibitors and sparged with nitrogen gas to remove oxygen. The polymerization initiator 2,2'-azobis(2methylpropionitrile), referred to as AIBN, was used as received.

To a suitable mixing vessel were added 750.0 grams of reagent grade toluene, 75.0 grams of dimethylaminoethyl methacrylate, 425.0 grams of methylmethacrylate, and 2.0 grams of AIBN. After a solution was obtained, the contents were transferred to the reactor that was preheated to maintain a 70° C. +/−1.0° C. polymerization temperature. After 5.0 hours of polymerization, a second addition of 0.5 gram of AIBN, dissolved in 100.0 grams of toluene, was accomplished. After an additional 6 hours of polymerization to complete the monomer conversion, the polymer solution was cooled and transferred to the polymer glass storage vessel using additional toluene to rinse out the polymer solution in the reactor. Upon characterization, the solution had a solids content of 22.7 percent by weight polymer, and a glass transition of 108.0° C. Molecular weight by gel permeation chromatography was $M_w$=90,000, $M_n$=40,000, MWD=2.3; percent nitrogen by CHN analysis was 1.31.

SYNTHETIC EXAMPLE II

Synthesis of a 90/10 weight percent copolymer, poly (methylmethacrylate-co-dimethylaminoethyl methacrylate) was accomplished by essentially repeating Example I.

In a suitable mixing vessel were added 750.0 grams of reagent grade toluene, 50.0 grams of dimethylaminoethyl methacrylate, 450.0 grams of methylmethacrylate, and 2.0 grams of AIBN. After a solution was obtained, the contents were transferred to the reactor that was preheated to maintain a 70° C. +/−1.0° C. polymerization temperature. After 5.25 hours of polymerization, a second addition of 0.5 gram of AIBN, dissolved in 60.0 grams of toluene, was accomplished. After an additional 6.75 hours of polymerization to complete the monomer conversion, the polymer solution was cooled and transferred to a glass storage vessel using additional toluene. Upon characterization, the solution had a solids content of 25.1 percent by weight polymer, and the polymer had glass transition of 110.3° C. Molecular weight by gel permeation chromatography was $M_w$=106,000, $M_w$=60,000 MWD=1.8. Percent nitrogen by CHN analysis was 0.99.

SYNTHETIC EXAMPLE III

Synthesis of a 85/15 weight percent copolymer, poly (methylmethacrylate-co-dimethylaminoethyl methacrylate) was completed with the same equipment setup and procedure as in Example I.

To a suitable mixing vessel were added 1,200.0 grams of reagent grade toluene, 120.0 grams of dimethylaminoethyl methacrylate, 680.0 grams of methylmethacrylate, and 3.2 grams of AIBN. After a solution was obtained, the contents were transferred to the reactor that was preheated to maintain a 70° C. +/−1.0° C. polymerization temperature. After 7.0 hours of polymerization, a second addition of 0.8 gram of AIBN, dissolved in 100.0 grams of toluene, was accomplished After an additional 7.0 hours of polymerization, to complete the monomer conversion, the polymer solution was cooled to about room temperature, about 25° C., and transferred to a glass storage vessel using additional toluene to rinse out the polymer solution in the reactor. Upon characterization, the solution had a solids content of 31.47 percent by weight polymer, and the polymer had a glass transition of 108.1° C. Molecular weight by gel permeation chromatography was $M_w$=119,000, $M_n$=73,000, MWD=1.6

Preparation of a 30 percent carbon black(70 percent polymer generated with the above synthesis was achieved as follows:

To a ball mill were added 1112.17 grams of the 31.47 percent solids polymer solution (equivalent to 350.0 grams of poly(methylmethacrylate-co-dimethylaminoethyl methacrylate 85/15 weight percent), and 150.0 grams of conductive carbon black (SC Ultra, obtained from Conductex) and 2.0 pounds of ⅛ inch stainless steel balls. After roll milling for 30 minutes, the polymer/carbon black mixture was separated from the stainless steel balls and air/vacuum dried until a granular solid was obtained, which solid contained 30 percent carbon black and 70 percent polymer.

SYNTHETIC EXAMPLE IV

Synthesis of a 90/10 weight percent copolymer, poly (methylmethacrylate-co-dimethylaminoethyl methacrylate) was accomplished with the same equipment setup and procedure as in Example I.

To a suitable mixing vessel were added 1,200.0 grams of reagent grade toluene, 120.0 grams of dimethylaminoethyl methacrylate, 680.0 grams of methylmethacrylate, and 3.2 grams of AIBN. After a solution was obtained, the contents were transferred to the reactor that was preheated to maintain a 70° +/−1.0° C. polymerization temperature. After 7.0 hours of polymerization, a second addition of 0.8 gram of AIBN, dissolved in 100.0 grams of toluene, was accomplished After an additional 7.0 hours of polymerization to complete the monomer conversion, the polymer solution was cooled and transferred to a glass storage vessel using additional toluene to rinse out the polymer solution in the reactor. Upon characterization, the solution had a solids content of 29.25 percent by weight polymer, and the polymer had a glass transition of 110.1° C. Molecular weight by gel permeation chromatography was $M_w$=~105,000, $M_n$=~60,000, MWD=~1.8.

Preparation of a 30 percent carbon black/70 percent polymer generated with the above synthesis was achieved as follows:

To a ball mill were added 1,196.6 grams of the 29.25 percent solids polymer solution (equivalent to 350.0 grams of poly(methylmethacrylate-co-dimethylaminoethyl methacrylate 90/10 weight percent), and 150.0 grams of conductive carbon black (SC Ultra, obtained from Conductex) and 2.0 pounds of ⅛ inch stainless steel balls. After roll milling for 30 minutes, the polymer/carbon black mixture was separated from the stainless steel balls and air/vacuum dried until a granular solid was obtained, which solid contained 30 percent carbon black and 70 percent of a 90/10 weight ratio poly(methylmethacrylate-co-dimethylaminoethyl methacrylate).

SYNTHETIC EXAMPLE V

Preparation of a 20 percent carbon black (SC Ultra, obtained from Conductex)/80 percent poly (methylmethacrylate-co-dimethylaminoethyl methacrylate 85/15 weight percent), (polymer Example III) was achieved as follows:

To a ball mill were added 1,271.0 grams of the 31.47 percent solids polymer solution (equivalent to 400.0 grams of poly(methyl methacrylate-co-dimethylaminoethyl methacrylate 85/15 weight percent), and 100.0 grams of conductive carbon black (SC Ultra, obtained from Conductex) and 2.0 pounds of ⅛ inch stainless steel balls. After roll milling for about 30 minutes, the polymer/carbon black mixture was separated from the stainless steel balls and air/vacuum dried until a granular solid was obtained, which solid was composed of 20 percent carbon black and 80 percent of a 85/15 weight ratio poly(methylmethacrylate-co-dimethylaminoethyl methacrylate) polymer.

SYNTHETIC EXAMPLE VI

Preparation of a 20 percent carbon black (SC Ultra, obtained from Conductex)/80 percent poly (methylmethacrylate-co-dimethylaminoethyl methacrylate 90/10 weight percent), (polymer Example IV) was achieved as follows:

To a ball mill were added 1,367.5 grams of the 29.25 percent solids polymer solution (equivalent to 400.0 grams of poly(methylmethacrylate-co-dimethylaminoethyl methacrylate 90110 weight percent) produced in Synthetic Example IV, and 100.0 grams of conductive carbon black (SC Ultra, obtained from Conductex) and 2.0 pounds of ⅛ inch stainless steel balls. After roll milling for about 30 minutes, the polymer/carbon black mixture was separated from the stainless steel balls and air/vacuum dried until a granular solid was obtained, which solid was composed of 20 percent carbon black and 80 percent of a 90/10 weight ratio poly(methylmethacrylate-co-dimethylaminoethyl methacrylate) polymer of Synthetic Example IV.

SYNTHETIC EXAMPLE VII

Poly(methyl methacrylate-co-diisopropylaminoethylmethacrylate) with a composition of 72.9 percent methylmethacrylate and 27.1 percent diisopropylaminoethyl methacrylate was prepared by suspension polymerization as follows:

A 2.5 liter jacketed glass reactor was fitted with a stainless steel stirrer, thermal couple temperature probe, water cooled condenser with nitrogen outlet, a nitrogen inlet, internal/external cooling capabilities, and heated with hot water circulating bath. The monomers selected were all passed through a column of basic aluminum oxide to remove inhibitors and sparged with nitrogen gas to remove oxygen. The polymerization initiator 2,2'-azobis(2-methylpropionitrile), referred to as AIBN, was used as received.

To a suitable mixing vessel were added 89.16 grams of diisopropylaminoethyl methacrylate, 239.34 grams of methylmethacrylate, and 1.31 grams of AIBN. This mixture was then stirred to dissolve the AIBN until a clear organic phase was obtained. The organic phase was then transferred to a 3.0 liter vessel that contained 1.00 killigram of a 2.5 percent by weight Air Products Airvol 603 Polyvinyl Alcohol, and 10.90 grams of potassium iodide aqueous phase inhibitor. The desired particle size was obtained by homogenizing the two phases with a Brinkmann homogenizer equipped with a Polytron Generator with three stationary and three moving rings of flat rotor design. Homogenization was conducted for five minutes at about 8,000 RPM. The resulting suspended organic phase was then transferred to the preheated reactor and stirred at about 65 RPM to maintain stability of the suspension. The suspension was then maintained at 70° C. +/−1.0° C. for 6 hours and 40 minutes to complete the polymerization. The polymer suspension was then cooled to room temperature, removed from the reactor, washed and centrifuged 5 times with a 90/10 volume ratio of methanol/water and finally washed with water only. The wet polymer suspension was then air dried, placed in a vacuum oven at from about 40.0° C. to 80.0° C. to complete drying, and further broken down to its primary particle size by ball milling followed by screen sieving.

The resulting suspension polymerized polymer had a volume median of about 4.0 $\mu$m, as determined by a Coulter Counter and a second pass glass transition onset temperature of 95.8° C. Molecular weight by gel permeation chromatography was $M_w$=520,000 $M_n$=238,000, MWD=2.2. Percent nitrogen by CHN analysis was 1.81 and percent amine monomer was 28.8 by NMR.

SYNTHETIC EXAMPLE VIII

Poly(methyl methacrylate-co-diisopropylaminoethylmethacrylate) with a composition of 86.4 percent methylmethacrylate and 13.6 percent diisopropylaminoethyl methacrylate was prepared by suspension polymerization as follows:

A 2.5 liter jacketed glass reactor was fitted with a stainless steel stirrer, thermal couple temperature probe, water cooled condenser with nitrogen outlet, a nitrogen inlet, internal/external cooling capabilities, and heated with a hot water circulating bath. The monomers were all passed through a column of basic aluminum oxide to remove inhibitors and sparged with nitrogen gas to remove oxygen. The polymerization initiator 2,2'-azobis(2-methylpropionitrile), referred to as AIBN, was used as received.

To a suitable mixing vessel were added 44.58 grams of diisopropylaminoethyl methacrylate, 283.90 grams of methylmethacrylate, and 1.31 grams of AIBN. This mixture was then stirred to dissolve the AIBN until a clear organic phase was obtained. The organic phase was then transferred to a 3.0 liter vessel that contained 1.00 killigram of a 2.5 percent by weight Air Products Airvol 603 Polyvinyl Alcohol, and 10.90 grams of potassium iodide aqueous phase inhibitor. The desired particle size was obtained by homogenizing the two phases with a Brinkmann homogenizer equipped with a Polytron Generator with three stationary and three moving rings of flat rotor design. Homogenization was conducted for five minutes at about 8,000 RPM. The resulting suspended organic phase was then transferred to the preheated reactor and stirred at about 80 RPM to maintain stability of the suspension. The suspension was then maintained at 70° C. +/−1.0° C. for 6 hours and 10 minutes to complete polymerization. The polymer suspension was then cooled to about room temperature, about 25° C., throughout the Examples, unless otherwise indicated, removed from the reactor, washed and centrifuged 5 times with a 90/10 volume ratio of methanol/water and final washed with water only. The wet polymer suspension was then air dried, placed in a vacuum oven at from about 40.0° C. to 80.0° C. to complete drying, and further broken or attrited down to its primary particle size by ball milling followed by screen sieving. The resulting suspension polymerized polymer had a volume median of about 5.0 $\mu$m (microns) and a second pass glass transition onset temperature of 108.2° C. Molecular weight by gel permeation chromatography was $M_w$=577,000, $M_n$=217,000, and MWD=2.7. Percent nitrogen by CHN analysis was 0.97 and 14.2 percent amine monomer by NMR.

SYNTHETIC EXAMPLE IX

A copolymer of 60 percent methylmethacrylate (MMA) and 40 percent dimethylaminoethyl methacrylate (DMAEMA) was synthesized by an emulsion polymerization procedure which involved initiation and growth of copolymer latex particles by continuous addition of the prescribed monomer mixture with a final solids content of from 15 percent by wt.(weight) to about 40 percent by weight A suitable reaction vessel providing mechanical stirring, nitrogen atmosphere, and thermostatic control was employed. The typical formulation utilized a nonionic surfactant at 5 percent by weight of monomers (Triton X-405, as received from Union Carbide Corporation) dissolved in 1 liter of distilled water. To this solution were added 2.1 grams of ammonium persulfate initiator, as obtained from the Aldrich Chemical Company, (0.46 percent based on weight of monomers) along with 100 grams of the prescribed monomer mixture. The reaction vessel was heated to 50° C., with exotherm to 58° C., during a 40 minute period. Addition of remaining monomer was continued at 2 to 3 grams/minute with heating at 65° C. and with a stirring rate of 116 rpm until completion.

Molecular weight ($M_w$) determined by gel permeation chromatography was typically in the range of 200,000 to 500,000, and for this specific Example was determined to be 320,000 ($M_n$=82,000, MWD=3.9). The copolymer powder of poly(MMA-co-DMAEMA) was isolated by freeze drying the latex in vacuo. The volume median particle diameter was 0.1 to 2.0 microns as estimated by light scattering of a redispersed aqueous suspension.

SYNTHETIC EXAMPLE X

A copolymer of 53 percent methylmethacrylate (MMA) and 47 percent diethylaminoethyl methacrylate (DEAEMA) was synthesized by emulsion copolymerization which involved initiation and growth of copolymer latex particles by continuous addition of monomer mixture, and which yielded a product with a solids content of from 15 percent by weight to about 22 percent by weight, in which the solids content was composed of the copolymer poly(MMA-co-DEAEMA) (53 percent/47 percent monomer ratio). A suitable reaction vessel, providing mechanical stirring, nitrogen atmosphere, and thermostatic control was employed for the initiation and growth of copolymer latex particles by continuous addition of the MMA/DEAEMA monomer mixture. The typical formulation utilized 5 percent by weight of monomers of a nonionic surfactant, specifically TX-405, (as received from Union Carbide Corporation) dissolved in 1 liter of distilled water. Ammonium persulfate initiator, as obtained from the Aldrich Chemical Company, (0.6 percent, by weight of monomers) was added to the reaction vessel and heating started. The polymerization was carried out between 55° C. and 65° C. (per Example IX above). Molecular weight ($M_w$) determined by gel permeation chromatography was 78,000 ($M_n$=20,000, MWD=4.0). The copolymer powder of poly(MMA-co-DEAEMA) (53 percent/47 percent monomer ratio) was isolated by freeze drying the latex in vacuo. The resulting number median particle diameter was 0.135 to 0.165 $\mu$m as estimated by light scattering of a redispersed aqueous suspension.

SYNTHETIC EXAMPLE XI

A copolymer of 86 percent by weight of methylmethacrylate (MMA) and 14 percent of diisopropylaminoethyl methacrylate (DIAEMA) was synthesized by an emulsion copolymerization which involved initiation and growth of copolymer latex particles by the continuous addition of monomer mixture and which yielded a product with a solids content of from 15 percent by weight to about 40 percent by weight. An emulsion procedure was utilized, whereby a solution of 0.1 percent by weight of ammonium persulfate and 2 percent by weight of a nonionic surfactant, Triton X-405 in 1 liter of distilled water, was prepared in a suitable reaction vessel, providing mechanical stirring, nitrogen atmosphere, and thermostatic control. Initiation and growth of latex particles was started by the addition of approximately 25 percent of the monomer mixture with the temperature at 50° C. Rapid stirring was continued until any exotherm was completed. This was followed by a continuous and metered addition of the remaining monomer mixture at a rate of 1.0 to 2.0 grams/minute. This polymerization stage was carried out between 55 to 56° C. with heating continued for an additional 1 to 3 hours. Molecular weight ($M_w$) was determined by gel permeation chromatography to be 680,000, with MWD=3.6 with the procedure described. The copolymer powder of poly(MMA-co-DIAEMA) (86 percent/14 percent monomer ratio) was isolated by freeze drying the latex in vacuo. The resulting polymer powder was determined to have a number median particle diameter of 0.1 to 0.90 micron as estimated by light scattering of a redispersed aqueous suspension.

SYNTHETIC EXAMPLE XII

Copolymers were prepared without added nonionic-surfactant by a process referred to as "soapless" or surfactant free emulsion polymerization ("SFP") at an overall solids content of 15 to 45 weight percent. Specifically a copolymer of 4 percent DIAEMA with 96 percent methyl methacrylate was prepared by dissolving 2.4 grams of ammonium persulfate in 1.0 liter of distilled water, in a suitable reaction vessel, providing mechanical stirring, nitrogen atmosphere, and thermostatic control. The temperature was controlled to 75° C. +/−1° C. as the monomer mixture (4 percent DIAEMA/96 percent MMA) was metered into the reaction vessel. The suspended polymer had a resulting number median particle diameter of 0.4 to 0.90 micron as determined by standard light scattering methods. Molecular weight, $M_w$, of the resulting freeze dried powder as determined by GPC methods was 50,000 to 120,000 with MwD ($M_w/M_n$)=2.2 to 3.0.

CARRIER EXAMPLE I

In the first step of the carrier coating process, 2.27 grams of the of copolymer, and more specifically, 85 percent methylmethacrylate (MMA) and 15 percent dimethylaminoethyl methacrylate (DMAEMA) prepared in Synthetic Example I and 2,266 grams of 65 micron volume median diameter irregular steel core (obtained from Hoeganaes), with the core size determined in this and all following carrier examples by a standard laser diffraction technique, were mixed. Prior to mixing with the core, the polymer was ground to 7.3 microns in an 0202 Jet-O-Mizer (Fluid Energy Aljet) using a feed pressure of 105 psi and a feed rate of 0.6 gram per minute. The mixing was accomplished in a V-Cone blender with the following process conditions: blender speed of 23.5 rotations per minute and a blend time of 30 minutes. There resulted uniformly distributed and electrostatically attached polymer on the core as determined by visual observation. In the second step, the resulting carrier particles were inserted into a rotating tube furnace for a period of 30 minutes. This furnace was maintained at a temperature of 350° F. thereby causing the polymer to melt and fuse to the core. This resulted in a continuous uniform polymer coating on the core. The product from the kiln was screened through an 84 TBC (Tensile Bolt Cloth) mesh screen to remove any large agglomerates. The final product was comprised of a carrier core with a total of 0.1 percent polymer by weight on the surface, with the weight percent poly(DMAEMA-co-MMA) (15 percent/85 percent monomer ratio) polymer on the carrier, determined in this and all following carrier examples by dividing the difference between the weights of the fused carrier and the carrier core by the weight of the fused carrier.

A developer composition was then prepared by mixing 200 grams of the above prepared carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer. Thereafter, the triboelectric charge on the carrier particles was determined by the known Faraday Cage process, and there was measured on the carrier a positive charge of 36.0 microcoulombs per gram. Further, the conductivity of the carrier as determined by forming a 0.1 inch long magnetic brush of the carrier particles, and measuring the conductivity by imposing a 10 volt potential across the brush was $5.1\times10^{-09}$ (mho-cm)$^{-1}$. Therefore, these carrier particles were conductive.

For comparison, a carrier generated under the same conditions as above comprising a carrier core with a total of 0.1 percent polymethylmethacrylate polymer by weight on the surface and blended into a developer composition under the same conditions as above yields a positive measured triboelectric charge on the carrier of 22.4 microcoulombs per gram of toner, substantially lower than that of the carrier comprising the above coating containing dimethylaminoethyl methacrylate.

CARRIER EXAMPLE II

In the first step of the carrier coating process, 6.78 grams of the copolymer of Carrier Example I, and more specifically, 85 percent methylmethacrylate (MMA) and 15 percent dimethylaminoethyl methacrylate (DMAEMA) generated via solution polymerization and 2,261 grams of 65 micron volume median diameter irregular steel core (obtained from Hoeganaes) were mixed. The conditions under which the carrier was processed were substantially identical to that of Carrier Example I, except that the furnace was maintained at a temperature of 300° F. The final product was comprised of a carrier core with a total of 0.3 percent coating weight polymer of poly(DMAEMA-co-MMA) (15 percent/85 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of a positive 40.3 microcoulombs per gram. Further, the conductivity of the carrier as determined by forming a 0.1 inch long magnetic brush of the carrier particles, and measuring the conductivity by imposing a 10 volt potential across the brush was $2.8\times10^{-09}$ (mho-cm)$^{-1}$. Therefore, these carrier particles were conductive.

For comparison, a carrier prepared under the same conditions as above comprising a carrier core with a total of 0.3 percent polymethylmethacrylate polymer by weight on the surface and blended into a developer composition under the same conditions as above yielded a positive measured triboelectric charge on the carrier of 24.1 microcoulombs per gram of toner, substantially lower than that of the carrier comprising a coating containing the above invention dimethylaminoethyl methacrylate/MMA.

CARRIER EXAMPLE III

In the first step of the carrier coating process, 22.46 grams of the copolymer of Carrier Example I of 85 percent methylmethacrylate (MMA) and 15 percent dimethylaminoethyl methacrylate (DMAEMA) and 2,246 grams of 65 micron volume median diameter irregular steel core (obtained from Hoeganaes) were mixed. The conditions under which the carrier was processed were substantially identical to that of Carrier Example I. The final product was comprised of a carrier core with a total of 1.0 percent coating weight polymer of poly(DMAEMA-co-MMA) (15 percent/85 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 63.2 microcoulombs per gram. Further, the conductivity of the carrier as determined by forming a 0.1 inch long magnetic brush of the carrier particles, and measuring the conductivity by imposing a 10 volt potential across the brush was $8.7\times10^{-10}$ (mho-cm)$^{-1}$. Therefore, these carrier particles were semiconductive.

For comparison, a carrier generated under the above same conditions, or same process as above comprising a carrier core with a total of 1.0 percent polymethylmethacrylate polymer (replacement for the copolymer above throughout) by weight on the surface and blended into a developer composition under the same conditions as above yielded a positive measured triboelectric charge on the carrier of 26.3 microcoulombs per gram of toner.

CARRIER EXAMPLE IV

In the first step of the carrier coating process, 2.27 grams of the copolymer of Carrier Example I of 85 percent methylmethacrylate (MMA) and 15 percent dimethylaminoethyl methacrylate (DMAEMA) and 2,66 grams of 100 micron spherical steel core (obtained from Nuclear Metals) were mixed. The conditions under which the carrier was processed were substantially identical to that of Carrier Example I. The final product was comprised of a carrier core with a total of 0.1 percent coating weight polymer of poly(DMAEMA-co-MMA) (15 percent/85 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 22.9 microcoulombs per gram. Further, the conductivity of the carrier as determined by forming a 0.1 inch long magnetic brush of the carrier particles, and measuring the conductivity by imposing a 10 volt potential across the brush was $1.1\times10^{-9}$ (mho-cm)$^{-1}$. Therefore, these carrier particles were conductive.

CARRIER EXAMPLE V

In the first step of the carrier coating process, 6.78 grams of the copolymer of Example I of 85 percent methylmethacrylate (MMA) and 15 percent dimethylaminoethyl methacrylate (DMAEMA) and 2,261 grams of 100 micron spherical steel core (obtained from Nuclear Metals) were mixed. The conditions under which the carrier was processed were identical to that of Carrier Example I, except that the furnace was maintained at a temperature of 300° F. The final product was comprised of a carrier core with a total of 0.3 percent coating weight polymer of poly(DMAEMA-co-MMA) (15 percent/85 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 34.2 microcoulombs per gram. Further, the conductivity of the carrier as determined by forming a 0.1 inch long magnetic brush of the carrier particles, and measuring the conductivity by imposing a 10 volt potential across the brush was $1.3\times10^{-12}$ (mho-cm)$^{-1}$. Therefore, these carrier particles were semiconductive.

CARRIER EXAMPLE VI

In the first step of the carrier coating process, 22.46 grams of the copolymer of Example I of 85 percent methylmethacrylate (MMA) and 15 percent dimethylaminoethyl methacrylate (DMAEMA) and 2,246 grams of 100 micron spherical steel core (obtained from Nuclear Metals) were mixed. The conditions under which the carrier was processed were identical (or substantially identical throughout) to that of Carrier Example I, except that the furnace was maintained at a temperature of 300° F. The final product was comprised of a carrier core with a total of 1.0 percent coating weight polymer of poly(DMAEMA-co-MMA) (15 percent/85 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 41.8 microcoulombs per gram. Further, the conductivity of the carrier as determined by forming a 0.1 inch long magnetic brush of the carrier particles, and measuring the conductivity by imposing a 10 volt potential across the brush was less than $1\times10^{-14}$ (ohm-cm)$^{-1}$. Therefore, these carrier particles were insulative.

CARRIER EXAMPLE VII

In the first step of the carrier coating process, 2.27 grams of a copolymer of 90 percent methylmethacrylate (MMA) and 10 percent dimethylaminoethyl methacrylate (DMAEMA) prepared in Synthetic Example II and 2,266 grams of 100 micron spherical steel core (obtained from Nuclear Metals) were mixed. Prior to mixing with the core, the polymer (copolymer) was ground to 7.8 microns in an 0202 Jet-O-Mizer (Fluid Energy Aljet) using a feed pressure of 102 psi and a feed rate of 5.0 grams per minute. The conditions under which the carrier was processed were identical to that of Carrier Example I. The final product was comprised of a carrier core with a total of 0.1 percent coating weight polymer of poly(DMAEMA-co-MMA) (10 percent/90 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 22.0 microcoulombs per gram. Further, the conductivity of the carrier as determined by forming a 0.1 inch long magnetic brush of the carrier particles, and measuring the conductivity by imposing a 10 volt potential across the brush was $3.4\times10^{-8}$ (mho-cm)$^{-1}$. Therefore, these carrier particles were conductive.

CARRIER EXAMPLE VIII

In the first step of the carrier coating process, 6.78 grams of the copolymer of Carrier Example VII of 90 percent methylmethacrylate (MMA) and 10 percent dimethylaminoethyl methacrylate (DMAEMA) and 2,261 grams of 100 micron spherical steel core (obtained from Nuclear Metals) were mixed. The conditions under which the carrier was processed were identical to that of Carrier Example I, except that the furnace was maintained at a temperature of 300° F. The final product was comprised of a carrier core with a total of 0.3 percent coating weight polymer of poly(DMAEMA-co-MMA) (10 percent/90 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 25.6 microcoulombs per gram. Further, the conductivity of the carrier as determined by forming a 0.1 inch long magnetic brush of the carrier particles, and measuring the conductivity by imposing a 10 volt potential across the brush was $2.3\times10^{-10}$ (mho-cm)$^{-1}$. Therefore, these carrier particles were semiconductive.

CARRIER EXAMPLE IX

In the first step of the carrier coating process, 6.78 grams of the copolymer of Example VII comprised of 90 percent methylmethacrylate (MMA) and 10 percent dimethylaminoethyl methacrylate (DMAEMA) and 2,261 grams of 65 micron volume median diameter irregular steel core (obtained from Hoeganaes) were mixed. The conditions under which the carrier was processed were identical to that of Carrier Example I. The final product was comprised of a carrier core with a total of 0.3 percent coating weight polymer of poly(DMAEMA-co-MMA) (10 percent/90 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 35.0 microcoulombs per gram. Further, the conductivity of the carrier as determined by forming a 0.1 inch long magnetic brush of the carrier particles, and measuring the conductivity by imposing a 10 volt potential across the brush was $4.8\times10^{-9}$ (mho-cm)$^{-1}$. Therefore, these carrier particles were conductive.

CARRIER EXAMPLE X

In the first step of the carrier coating process, 22.46 grams of a copolymer of 59.5 percent methylmethacrylate (MMA), 10.5 percent dimethylaminoethyl methacrylate (DMAEMA), and 30 percent conductive carbon black (SC Ultra, obtained from Conductex), and as prepared in Synthetic Example III and 2,246 grams of 65 micron volume median diameter irregular steel core (obtained from Hoeganaes) were mixed. Prior to mixing with the core, the polymer was ground to 5.2 microns in an 0202 Jet-O-Mizer (Fluid Energy Aljet) using a feed pressure of 1 10 psi and a feed rate of 1.3 grams per minute. The conditions under which the carrier was processed were identical to that of Carrier Example I. The final product was comprised of a carrier core with a total of 1.0 percent coating weight polymer of 70 percent by weight poly(DMAEMA-co-MMA) (15 percent/85 percent monomer ratio) and 30 percent Conductex SC Ultra carbon black by weight on the carrier core surface.

A developer composition was then prepared in the same manner as Carrier Example I. Thereafter, the triboelectric charge on the carrier particles was determined by the known Faraday Cage process, and there was measured on the carrier a charge of 35.0 microcoulombs per gram. Thereafter, the triboelectric charge on the carrier particles was determined by the known Faraday Cage process, and there was measured on the carrier a charge of 23.5 microcoulombs per gram. Further, the conductivity of the carrier as determined by forming a 0.1 inch long magnetic brush of the carrier particles, and measuring the conductivity by imposing a 10 volt potential across the brush was $4.2\times10^{-7}$ (mho-cm)$^{-1}$. Therefore, these carrier particles were conductive.

CARRIER EXAMPLE XI

In the first step of the carrier coating process, 22.46 grams of a copolymer of 64 percent methylmethacrylate (MMA), 6 percent dimethylaminoethyl methacrylate (DMAEMA), and 30 percent conductive carbon black (SC Ultra, obtained from Conductex), prepared in Synthetic Example IV and 2,246 grams of 65 micron volume median diameter irregular steel core (obtained from Hoeganaes) were mixed. Prior to mixing with the core, the polymer was ground to 6.0 microns in an 0202 Jet-O-Mizer (Fluid Energy Aljet) using a feed pressure of 110 psi and a feed rate of 2.0 grams per minute. The conditions under which the carrier was processed were identical to that of Carrier Example I. The final product was comprised of a carrier core with a total of 1.0 percent coating weight polymer of 70 percent by weight poly(DMAEMA-co-MMA) (10 percent/90 percent monomer ratio) and 30 percent Conductex SC Ultra carbon black by weight on the surface, and with the carbon black dispersed in the copolymer coating.

A developer composition was then prepared in the same manner as Carrier Example I. Thereafter, the triboelectric charge on the carrier particles was determined by the known Faraday Cage process, and there was measured on the carrier a charge of 35.1 microcoulombs per gram. Further, the conductivity of the carrier as determined by forming a 0.1 inch long magnetic brush of the carrier particles, and measuring the conductivity by imposing a 10 volt potential across the brush was $7.2\times10^{-8}$ (mho-cm)$^{-1}$. Therefore, these carrier particles were conductive.

CARRIER EXAMPLE XII

In the first step of the carrier coating process, 22.46 grams of the copolymer of Carrier Example XI of 64 percent methylmethacrylate (MMA), 6 percent dimethylaminoethyl methacrylate (DMAEMA), and 30 percent conductive carbon black (SC Ultra, obtained from Conductex) and 2,246 grams of 100 micron spherical steel core (obtained from Nuclear Metals) were mixed. The conditions under which the carrier was processed were identical to that of Carrier Example I. The final product was comprised of a carrier core with a total of 1.0 percent coating weight polymer of 70 percent by weight poly(DMAEMA-co-MMA) (10 percent/90 percent monomer ratio) and 30 percent Conductex SC Ultra carbon black by weight on the surface.

A developer composition was then prepared in the same manner as Carrier Example I. Thereafter, the triboelectric charge on the carrier particles was determined by the known Faraday Cage process, and there was measured on the carrier a charge of 23.0 microcoulombs per gram. Further, the conductivity of the carrier as determined by forming a 0.1 inch long magnetic brush of the carrier particles, and measuring the conductivity by imposing a 10 volt potential across the brush was $5.3\times10^{-7}$ (mho-cm)$^{-1}$. Therefore, these carrier particles were conductive.

CARRIER EXAMPLE XIII

In the first step of the carrier coating process, 22.46 grams of a copolymer of 68 percent methylmethacrylate (MMA), 12 percent dimethylaminoethyl methacrylate (DMAEMA), and 20 percent conductive carbon black (SC Ultra, obtained from Conductex) prepared in Synthetic Example V and 2,246 grams of 65 micron volume median diameter irregular steel core (obtained from Hoeganaes) were mixed. Prior to mixing with the core, the polymer was ground to 5.7 microns in an 0202 Jet-O-Mizer (Fluid Energy Aljet) using a feed pressure of 110 psi and a feed rate of 1.1 grams per minute. The conditions under which the carrier was processed were identical to that of Carrier Example I. The final product was comprised of a carrier core with a total of 1.0 percent coating weight polymer of 80 percent by weight poly(DMAEMA-co-MMA) (15 percent/85 percent monomer ratio) and 20 percent Conductex SC Ultra carbon black by weight on the surface.

A developer composition was then prepared in the same manner as Carrier Example I. Thereafter, the triboelectric charge on the carrier particles was determined by the known Faraday Cage process, and there was measured on the carrier a charge of 40.9 microcoulombs per gram. For comparison, a carrier prepared under the same conditions as above comprising a carrier core with a total of 1.0 percent by weight polymethylmethacrylate polymer containing 19 percent by weight carbon black (SC Ultra, obtained from Conductex) generated by a semisuspension polymerization process on the surface and blended into a developer composition under the same conditions as above yielded a positive measured triboelectric charge on the carrier of 16.7 microcoulombs per gram of toner.

Further, the conductivity of the carrier as determined by forming a 0.1 inch long magnetic brush of the carrier particles, and measuring the conductivity by imposing a 10 volt potential across the brush was $1.3\times10^{-8}$ (mho-cm)$^{-1}$. Therefore, these carrier particles were conductive.

CARRIER EXAMPLE XIV

In the first step of the carrier coating process, 22.46 grams of the copolymer of Carrier Example XIII of 68 percent methylmethacrylate (MMA), 12 percent dimethylaminoethyl methacrylate (DMAEMA), and 20 percent conductive carbon black (SC Ultra, obtained from Conductex) and 2,246 grams of 100 micron spherical steel core (obtained from Nuclear Metals) were mixed. The conditions under which the carrier was processed were identical to that of Carrier Example I. The final product was comprised of a carrier core with a total of 1.0 percent coating weight polymer of 80 percent by weight poly(DMAEMA-co-MMA) (15 percent/85 percent monomer ratio) and 20 percent Conductex SC Ultra carbon black by weight on the surface.

A developer composition was then prepared in the same manner as Carrier Example I. Thereafter, the triboelectric charge on the carrier particles was determined by the known Faraday Cage process, and there was measured on the carrier a charge of 30.4 microcoulombs per gram. Further, the conductivity of the carrier as determined by forming a 0.1 inch long magnetic brush of the carrier particles, and measuring the conductivity by imposing a 10 volt potential across the brush was $8.0\times10^{-9}$ (mho-cm)$^{-1}$. Therefore, these carrier particles were conductive.

CARRIER EXAMPLE XV

In the first step of the carrier coating process, 22.46 grams of a copolymer of 72 percent methylmethacrylate (MMA), 8 percent dimethylaminoethyl methacrylate (DMAEMA), and 20 percent conductive carbon black (SC Ultra, obtained from Conductex) prepared in Synthetic Example VI and 2,246 grams of 65 micron volume median diameter irregular steel core (obtained from Hoeganaes) were mixed. Prior to mixing with the core, the polymer was ground to 5.8 microns in an 0202 Jet-O-Mizer (Fluid Energy Aljet) using a feed pressure of 110 psi and a feed rate of 1.2 grams per minute. The conditions under which the carrier was processed were identical to that of Carrier Example I, except that the furnace was maintained at a temperature of 300° F. The final product was comprised of a carrier core with a total of 1.0 percent coating weight polymer of 80 percent by weight poly (DMAEMA-co-MMA) (10 percent/90 percent monomer ratio) and 20 percent Conductex SC Ultra carbon black by weight on the surface.

A developer composition was then prepared in the same manner as Carrier Example I. Thereafter, the triboelectric charge on the carrier particles was determined by the known Faraday Cage process, and there was measured on the carrier a charge of 36.1 microcoulombs per gram. Further, the conductivity of the carrier as determined by forming a 0.1 inch long magnetic brush of the carrier particles, and measuring the conductivity by imposing a 10 volt potential across the brush was $5.4\times10^{-9}$ (mho-cm)$^{-1}$. Therefore, these carrier particles were conductive.

CARRIER EXAMPLE XVI

In the first step of the carrier coating process, 22.46 grams of the copolymer of Carrier Example XV of 72 percent methylmethacrylate (MMA), 8 percent dimethylaminoethyl methacrylate (DMAEMA), and 20 percent conductive carbon black (SC Ultra, obtained from Conductex) made via Solution Polymerization and 2,246 grams of 100 micron spherical steel core (obtained from Nuclear Metals) were mixed. The conditions under which the carrier was processed were identical to that of Carrier Example I, except that the furnace was maintained at a temperature of 300° F. The final product was comprised of a carrier core with a total of 1.0 percent coating weight polymer of 80 percent by weight poly(DMAEMA-co-MMA) (10 percent/90 percent monomer ratio) and 20 percent Conductex SC Ultra carbon black by weight on the surface.

A developer composition was then prepared in the same manner as Carrier Example I. Thereafter, the triboelectric charge on the carrier particles was determined by the known Faraday Cage process, and there was measured on the carrier a charge of 27.6 microcoulombs per gram. Further, the conductivity of the carrier as determined by forming a 0.1 inch long magnetic brush of the carrier particles, and measuring the conductivity by imposing a 10 volt potential across the brush was $1.2\times10^{-8}$ (mho-cm)$^{-1}$. Therefore, these carrier particles were conductive.

CARRIER EXAMPLE XVIIA

In the first step of the carrier coating process, 22.46 grams of a copolymer of 72.9 percent methylmethacrylate (MMA) and 27.1 percent diisopropylaminoethylmethacrylate (DIAEMA) with a volume median particle diameter of 7.3 microns prepared via suspension polymerization in Synthetic Example VII and 2,246 grams of 65 micron volume median diameter irregular steel core (obtained from Hoeganaes) were mixed. The conditions under which the carrier was processed were identical to that of Carrier Example I. The final product was comprised of a carrier core with a total of 1.0 percent coating weight polymer of poly(DIAEMA-co-MMA) (27.1 percent/72.9 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 53.2 microcoulombs per gram. Further, the conductivity of the carrier as determined by forming a 0.1 inch long magnetic brush of the carrier particles, and measuring the conductivity by imposing a 10 volt potential across the brush was $5.3\times10^{-10}$ (mho-cm)$^{-1}$. Therefore, these carrier particles were semiconductive.

CARRIER EXAMPLE XVIIB

In the first step of the carrier coating process, 22.46 grams of the copolymer of Carrier Example VII of 72.9 percent methylmethacrylate (MMA) and 27.1 percent diisopropylaminoethylmethacrylate (DIAEMA) generated via a suspension polymerization process and 2,246 grams of 100 micron spherical steel core (obtained from Nuclear Metals) were mixed. The conditions under which the carrier was processed were identical to that of Carrier Example I. The final product was comprised of a carrier core with a total of 1.0 percent coating weight polymer of poly(DIAEMA-co-MMA) (27.1 percent/72.9 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 50.5 microcoulombs per gram. Further, the conductivity of the carrier as determined by forming a 0.1 inch long magnetic brush of the carrier particles, and measuring the conductivity by imposing a 10 volt potential across the brush less than $1\times10^{-14}$ (ohm-cm)$^{-1}$. Therefore, these carrier particles were insulative.

CARRIER EXAMPLE XIX

In the first step of the carrier coating process, 20.34 grams of a copolymer of 86.4 percent methylmethacrylate (MMA) and 13.6 percent diisopropylaminoethylmethacrylate (DIAEMA) with a volume median particle diameter of 4.1 microns prepared via suspension polymerization in Synthetic Example VIII and 2,246 grams of 65 micron volume median diameter irregular steel core (obtained from Hoeganaes) were mixed. The conditions under which the carrier was processed were identical to that of Carrier Example I. The final product was comprised of a carrier core with a total of 0.3 percent coating weight polymer of poly(DIAEMA-co-MMA) (13.6 percent/86.4 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 32.7 microcoulombs per gram. Further, the conductivity of the carrier as determined by forming a 0.1 inch long magnetic brush of the carrier particles, and measuring the conductivity by imposing a 10 volt potential across the brush was $8.1\times10^{-9}$ (mho-cm)–1. Therefore, these carrier particles were conductive.

CARRIER EXAMPLE XX

In the first step of the carrier coating process, 67.38 grams of the copolymer of Carrier Example XIX of 86 percent methylmethacrylate (MMA) and 14 percent diisopropylaminoethylmethacrylate (DIAEMA) generated via a suspension polymerization process as illustrated herein, and 6,738 grams of 65 micron volume median diameter irregular steel core (obtained from Hoeganaes) were mixed. The conditions under which the carrier was processed were identical to that of Carrier Example I. The final product was comprised of a carrier core with a total of 1.0 percent coating weight polymer of poly(DIAEMA-co-MMA) (13.6 percent/86.4 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 44.4 microcoulombs per gram. Further, the conductivity of the carrier as determined by forming a 0.1 inch long magnetic brush of the carrier particles, and measuring the conductivity by imposing a 10 volt potential across the brush was $8.25\times10^{-10}$ (mho-cm)$^{-1}$. Therefore, these carrier particles were semiconductive.

CARRIER EXAMPLE XXI

In the first step of the carrier coating process, 22.46 grams of the copolymer of Carrier Example XIX of 86 percent methylmethacrylate (MMA) and 14 percent diisopropylaminoethylmethacrylate (DIAEMA) generated via a suspension polymerization process and 2,246 grams of 100 micron spherical steel core (obtained from Nuclear Metals) were mixed. The conditions under which the carrier was processed were identical to that of Carrier Example I. The final product was comprised of a carrier core with a total of 1.0 percent coating weight polymer of poly(DIAEMA-co-MMA) (13.6 percent/86.4 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 65.3 microcoulombs per gram. Further, the conductivity of the carrier as determined by forming a 0.1 inch long magnetic brush of the carrier particles, and measuring the conductivity by imposing a 10 volt potential across the brush was less than $1\times10^{-14}$ (ohm-cm)$^{-1}$. Therefore, these carrier particles were insulative.

CARRIER EXAMPLE XXII

In the first step of the carrier coating process, 44.91 grams of the copolymer of 60 percent methylmethacrylate (MMA) and 40 percent dimethylaminoethyl methacrylate (DMAEMA) generated with a particle size of 0.5 microns and which copolymer was prepared via emulsion polymerization in Synthetic Example IX and 4,491 grams of 100 micron volume median diameter spherical steel core (obtained from Nuclear Metals) were mixed. The mixing was accomplished in a M5R blender with the following process conditions: blender speed of 50 rotations per minute and a blend time of 30 minutes. There resulted uniformly distributed and electrostatically attached polymer on the core as determined by visual observation. In the second step, the resulting carrier particles were inserted into a rotating tube furnace for a period of 30 minutes. This furnace was maintained at a temperature of 350° F. thereby causing the polymers to melt and fuse to the core. The product from the kiln was screened through an 84 TBC (Tensile Bolt Cloth) mesh screen to remove any large agglomerates. The final product was comprised of a carrier core with a total of 1.0 percent coating weight polymer of poly(DMAEMA-co-MMA) (40 percent/60 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 59.1 microcoulombs per gram. Further, the conductivity of the carrier as determined by forming a 0.1 inch long magnetic brush of the carrier particles, and measuring the conductivity by imposing a 10 volt potential across the brush was less than $1\times10^{-14}$ (ohm-cm)$^{-1}$. Therefore, these carrier particles were insulative.

CARRIER EXAMPLE XXIII

In the first step of the carrier coating process, 4.53 grams of the copolymer of Carrier Example XXII of 60 percent methylmethacrylate (MMA) and 40 percent dimethylaminoethyl methacrylate (DMAEMA) generated via an emulsion polymerization process and 4,531 grams of 65 micron volume median diameter irregular steel core (obtained from Hoeganaes) were mixed. The conditions under which the carrier was processed were identical to that of Carrier Example XXII. The final product was comprised of a carrier core with a total of 0.1 percent coating weight polymer of poly(DMAEMA-co-MMA) (40 percent/60 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 50.9 microcoulombs per gram. Further, the conductivity of the carrier as determined by forming a 0.1 inch long magnetic brush of the carrier particles, and measuring the conductivity by imposing a 10 volt potential across the brush was $1.4\times10^{-8}$ mho-cm$^{-1}$. Therefore, these carrier particles were conductive.

CARRIER EXAMPLE XIV

In the first step of the carrier coating process, 13.57 grams of the copolymer of Carrier Example XXII of 60 percent methylmethacrylate (MMA) and 40 percent dimethylaminoethyl methacrylate (DMAEMA) generated via an emulsion polymerization process as illustrated herein, and 4,522 grams of 65 micron volume median diameter irregular steel core (obtained from Hoeganaes) were mixed. The conditions under which the carrier was processed were identical to that of Carrier Example XXII. The final product was comprised of a carrier core with a total of 0.3 percent coating weight polymer of poly(DMAEMA-co-MMA) (40 percent/60 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 76.3 microcoulombs per gram. Further, the conductivity of the carrier as determined by forming a 0.1 inch long magnetic brush of the carrier particles, and measuring the conductivity by imposing a 10 volt potential across the brush was $1.9\times10^{-9}$ (mho-cm)$^{-1}$. Therefore, these carrier particles were conductive.

CARRIER EXAMPLE XXV

In the first step of the carrier coating process, 31.53 grams of the copolymer of Carrier Example XXII of 60 percent methylmethacrylate (MMA) and 40 percent dimethylaminoethyl methacrylate (DMAEMA) generated via an emulsion polymerization process and 4,504 grams of 65 micron volume median diameter irregular steel core (obtained from Hoeganaes) were mixed. The conditions under which the carrier was processed were identical to that of Carrier Example XXII. The final product was comprised of a carrier core with a total of 0.7 percent coating weight polymer of poly(DMAEMA-co-MMA) (40 percent/60 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 86.2 microcoulombs per gram. Further, the conductivity of the carrier as determined by forming a 0.1 inch long magnetic brush of the carrier particles, and measuring the conductivity by imposing a 10 volt potential across the brush was $2.7\times10^{-12}$ (mho-cm)$^{-1}$. Therefore, these carrier particles were semiconductive.

CARRIER EXAMPLE XXVI

In the first step of the carrier coating process, 43.54 grams of the copolymer of Carrier Example XXII of 60 percent methylmethacrylate (MMA) and 40 percent dimethylaminoethyl methacrylate (DMAEMA) generated via an emulsion polymerization process and 4,354 grams of 65 micron volume median diameter irregular steel core (obtained from Hoeganaes) were mixed. The conditions under which the carrier was processed were identical to that of Carrier Example XXII. The final product was comprised of a carrier core with a total of 1.0 percent coating weight polymer of poly(DMAEMA-co-MMA) (40 percent/60 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 91.7 microcoulombs per gram. Further, the conductivity of the carrier as determined by forming a 0.1 inch long magnetic brush of the carrier particles, and measuring the conductivity by imposing a 10 volt potential across the brush was less than $1\times10^{-14}$ (ohm-cm)$^{-1}$. Therefore, these carrier particles were insulative.

CARRIER EXAMPLE XXVII

In the first step of the carrier coating process, 22.46 grams of a copolymer comprised of 90 percent methylmethacrylate (MMA) and 10 percent dimethylaminoethyl methacrylate (DMAEMA) generated via the emulsion polymerization process described in Synthetic Example IX but with a 90:10 ratio of MMA to DMAEMA monomers, and with a resulting resin particle size of 0.1 to 2.0 microns, and 2,246 grams of 100 micron volume median diameter spherical steel core (obtained from Nuclear Metals) were mixed. The conditions under which the carrier was processed are identical to that of Carrier Example I. The final product was comprised of a carrier core with a total of 1.0 percent coating weight polymer of poly(DMAEMA-co-MMA) (10 percent/90 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 43.0 microcoulombs per gram. Further, the conductivity of the carrier as determined by forming a 0.1 inch long magnetic brush of the carrier particles, and measuring the conductivity by imposing a 10 volt potential across the brush was $1.8\times10^{-13}$ (mho-cm)$^{-1}$. Therefore, these carrier particles were insulative.

CARRIER EXAMPLE XXVIII

In the first step of the carrier coating process, 22.46 grams of the copolymer comprised of 53 percent methylmethacrylate (MMA) and 47 percent diethylaminoethyl methacrylate (DEAEMA) generated with a particle size of 0.5 micron prepared via emulsion polymerization in Synthetic Example X and 2,246 grams of 100 micron volume median diameter spherical steel core (obtained from Nuclear Metals) were mixed. The conditions under which the carrier was processed are identical to that of Carrier Example I. The final product was comprised of a carrier core with a total of 1.0 percent coating weight polymer of poly(DEAEMA-co-MMA) (47 percent/53 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 45.9 microcoulombs per gram. Further, the conductivity of the carrier as determined by forming a 0.1 inch long magnetic brush of the carrier particles, and measuring the conductivity by imposing a 10 volt potential across the brush was $4.6\times10^{-14}$ (mho-cm)$^{-1}$. Therefore, these carrier particles were insulative.

CARRIER EXAMPLE XXIX

In the first step of the carrier coating process, 22.46 grams of the copolymer comprised of 86 percent methylmethacrylate (MMA) and 14 percent diisopropylaminoethylmethacrylate (DIAEMA) generated with a particle size of 0.5 micron prepared via emulsion polymerization in Synthetic Example XI and 2,246 grams of 100 micron volume median diameter spherical steel core (obtained from Nuclear Metals) were mixed. The conditions under which the carrier was processed were identical to that of Carrier Example I. The final product was comprised of a carrier core with a total of 1.0 percent coating weight polymer of poly(DIAEMA-co-MMA) (14 percent/86 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 42.1 microcoulombs per gram. Further, the conductivity of the carrier as determined by forming a 0.1 inch long magnetic brush of the carrier particles, and measuring the conductivity by imposing a 10 volt potential across the brush was less than $1\times10^{-14}$ (ohm-cm)$^{-1}$. Therefore, these carrier particles were insulative.

CARRIER EXAMPLE XXX

In the first step of the carrier coating process, 11.35 grams of the copolymer comprised of 72.9 percent methylmethacrylate (MMA) and 27.1 percent diisopropylaminoethylmethacrylate (DIAEMA), 34.05 grams of a thermosetting crosslinked polyester/polyurethane second polymer (Envirocron PCU10101, obtained from PPG Industries) with a particle size of between 4 and 7 microns, and 4,540 grams of 65 micron Hoeganaes core were mixed. The mixing was accomplished in a M5R blender with the following process conditions: blender speed of 50 rotations per minute and a blend time of 40 minutes. There resulted uniformly distributed and electrostatically attached polymer on the core as determined by visual observation. In the second step, the resulting carrier particles were inserted into a rotating tube furnace for a period of 30 minutes. This furnace was maintained at a temperature of 360° F. thereby causing the polymers to melt and fuse to the core. There resulted a uniform and continuous polymer coating on the carrier core. The product from the kiln was screened through an 84 TBC (Tensile Bolt Cloth) mesh screen to remove any large agglomerates. The final product was comprised of a carrier core with a total of 1.0 percent coating weight polymer of 25 weight percent (weight percent)poly(DIAEMA-co-MMA) (27.1 percent/72.9 percent monomer ratio) and 75 weight percent crosslinked polyester/polyurethane on the carrier surface.

A developer composition was then prepared in the same manner as Carrier Example I. Thereafter, the triboelectric charge on the carrier particles was determined by the known Faraday Cage process, and there was measured on the carrier a charge of 96.49 microcoulombs per gram. Further, the conductivity of the carrier as determined by forming a 0.1 inch long magnetic brush of the carrier particles, and measuring the conductivity by imposing a 10 volt potential across the brush was 9.78 $E^{-16}$ mho-cm$^{-1}$. Therefore, these carrier particles were insulative.

CARRIER EXAMPLE XXXI

In the first step of the carrier coating process, 11.35 grams of the copolymer of Carrier Example VII, 34.05 grams of a thermosetting polyester/polyurethane polymer (Envirocron PCU10101, obtained from PPG Industries) containing 20 percent by weight of an electrically conductive carbon black (SC Ultra, obtained from Conductex, Inc.) with a volume median particle size of 5.1 microns, and 4,540 grams of 65 micron Hoeganaes core were mixed. The conditions under which the carrier was processed were identical to that of Carrier Example XXX, except that the furnace was maintained at a temperature of 380° F. The final product was comprised of a carrier core with a total of 1.0 percent coating weight polymer of 25 weight percent poly(DIAEMA-co-MMA) (27.1 percent/72.9 percent monomer ratio), 60 weight percent crosslinked polyester/polyurethane, and 15 weight percent conductive carbon black on the carrier surface.

A developer composition was then prepared in the same manner as Carrier Example I. Thereafter, the triboelectric charge on the carrier particles was determined by the known Faraday Cage process, and there was measured on the carrier a charge of 66.99 microcoulombs per gram. Further, the conductivity of the carrier as determined by forming a 0.1 inch long magnetic brush of the carrier particles, and measuring the conductivity by imposing a 10 volt potential across the brush was 5.42 $E^{-9}$ mho-cm$^{-1}$. Therefore, these carrier particles were conductive.

CARRIER EXAMPLE XXXII

In the first step of the carrier coating process, 11.35 grams of the copolymer of Carrier Example VII, 34.05 grams of a thermosetting polyester/polyurethane polymer (Envirocron PCU10101, obtained from PPG Industries) containing 30 percent by weight of an electrically conductive carbon black (SC Ultra, obtained from Conductex, Inc.) with a particle size of between 4 and 7 microns, and 4,540 grams of 65 micron Hoeganaes core were mixed. The conditions under which the carrier was processed are identical to that of Carrier Example XXX, except that the furnace was maintained at a temperature of 400° F. The final product was comprised of a carrier core with a total of 1.0 percent coating weight polymer of 25 weight percent poly(DIAEMA-co-MMA) (27.1 percent/72.9 percent monomer ratio), 52.5 weight percent crosslinked polyester/polyurethane, and 22.5 weight percent conductive carbon black on the carrier surface.

A developer composition was then prepared in the same manner as Carrier Example I. Thereafter, the triboelectric charge on the carrier particles was determined by the known Faraday Cage process, and there was measured on the carrier a charge of 62.91 microcoulombs per gram. Further, the conductivity of the carrier as determined by forming a 0.1 inch long magnetic brush of the carrier particles, and measuring the conductivity by imposing a 10 volt potential across the brush was 9.46 $E^{-9}$ mho-cm$^{-1}$. Therefore, these carrier particles were conductive.

CARRIER EXAMPLE XXXIII

In the first step of the carrier coating process, 22.7 grams of the copolymer of Carrier Example VII, 22.7 grams of a thermosetting polyester/polyurethane polymer (Envirocron PCU10101, obtained from PPG Industries) containing 30 percent by weight of an electrically conductive carbon black (SC Ultra, obtained from Conductex, Inc.) with a particle size of between 4 and 7 microns, and 4,540 grams of 65 micron Hoeganaes core were mixed. The conditions under which the carrier was processed are identical to that of Carrier Example XXX, except that the furnace was maintained at a temperature of 380° F. The final product was comprised of a carrier core with a total of 1.0 percent coating weight polymer of 50 weight percent poly(DIAEMA-co-MMA) (27.1 percent/72.9 percent monomer ratio), 35 weight percent crosslinked polyester/polyurethane, and 15 weight percent conductive carbon black on the carrier surface.

A developer composition was then prepared in the same manner as Carrier Example I. Thereafter, the triboelectric charge on the carrier particles was determined by the known Faraday Cage process, and there was measured on the carrier a charge of 75.27 microcoulombs per gram. Further, the conductivity of the carrier as determined by forming a 0.1 inch long magnetic brush of the carrier particles, and measuring the conductivity by imposing a 10 volt potential across the brush was 8.74 $E^{-10}$ mho-cm$^{-1}$. Therefore, these carrier particles were conductive.

CARRIER EXAMPLE XXXIV

In the first step of the carrier coating process, 22.7 grams of the copolymer of Carrier Example VII, 22.7 grams of a thermosetting polyester/polyurethane polymer (Envirocron PCU10101, obtained from PPG Industries) with a particle size of between 4 and 7 microns, and 4,540 grams of 65 micron Hoeganaes core were mixed. The conditions under which the carrier was processed are identical to that of Carrier Example XXX, except that the furnace was maintained at a temperature of 400° F. The final product was comprised of a carrier core with a total of 1.0 percent coating weight polymer consisting of 50 weight percent poly (DIAEMA-co-MMA) (27.1 percent/72.9 percent monomer ratio) and 50 weight percent crosslinked polyester/polyurethane on the carrier surface.

A developer composition was then prepared in the same manner as Carrier Example I. Thereafter, the triboelectric charge on the carrier particles was determined by the known Faraday Cage process, and there was measured on the carrier a charge of 83.25 microcoulombs per gram. Further, the conductivity of the carrier as determined by forming a 0.1 inch long magnetic brush of the carrier particles, and measuring the conductivity by imposing a 10 volt potential across the brush was 3.55 $E^{-15}$ mho-cm$^{-1}$. Therefore, these carrier particles were insulative.

CARRIER EXAMPLE XXXV

In the first step of the carrier coating process, 22.7 grams of the copolymer of Carrier Example VII, 22.7 grams of a thermosetting polyester/polyurethane polymer (Envirocron PCU10101, obtained from PPG Industries) containing 20 percent by weight of an electrically conductive carbon black (SC Ultra, obtained from Conductex, Inc.) with a particle size of between 4 and 7 microns, and 4,540 grams of 65 micron Hoeganaes core were mixed. The conditions under which the carrier was processed are identical to that of Carrier Example XXX, except that the furnace was maintained at a temperature of 380° F. The final product was comprised of a carrier core with a total of 1.0 percent coating weight polymer of 50 weight percent poly(DIAEMA-co-MMA) (27.1 percent/72.9 percent monomer ratio), 40 weight percent crosslinked polyester/polyurethane, and 10 weight percent conductive carbon black on the carrier surface.

A developer composition was then prepared in the same manner as Carrier Example I. Thereafter, the triboelectric charge on the carrier particles was determined by the known Faraday Cage process, and there was measured on the carrier a charge of 85.57 microcoulombs per gram. Further, the conductivity of the carrier as determined by forming a 0.1 inch long magnetic brush of the carrier particles, and measuring the conductivity by imposing a 10 volt potential across the brush was 1.14 $E^{-10}$ mho-cm$^{-1}$. Therefore, these carrier particles were conductive.

CARRIER EXAMPLE XXXVI

In the first step of the carrier coating process, 34.05 grams of the copolymer of Carrier Example VII, 11.35 grams of a thermosetting polyester/polyurethane polymer (Envirocron PCU10101, obtained from PPG Industries) containing 20 percent by weight of an electrically conductive carbon black (SC Ultra, obtained from Conductex, Inc.) with a volume average diameter particle size of between 4 and 7 microns and 4,540 grams of 65 micron Hoeganaes core were mixed. The conditions under which the carrier was processed are identical to that of Carrier Example XXX, except that the furnace was maintained at a temperature of 400° F. The final product was comprised of a carrier core with a total of 1.0 percent coating weight polymer consisting of 75 weight percent poly(DIAEMA-co-MMA) (27.1 percent/72.9 percent monomer ratio), 20 weight percent crosslinked polyester/polyurethane, and 5 weight percent conductive carbon black on the carrier surface.

A developer composition was then prepared in the same manner as Carrier Example I. Thereafter, the triboelectric charge on the carrier particles was determined by the known Faraday Cage process, and there was measured on the carrier a charge of 88.96 microcoulombs per gram. Further, the conductivity of the carrier as determined by forming a 0.1 inch long magnetic brush of the carrier particles, and measuring the conductivity by imposing a 10 volt potential across the brush was 6.36 $E^{-15}$ mho-cm$^{-1}$. Therefore, these carrier particles were insulative.

CARRIER EXAMPLE XXXVII

In the first step of the carrier coating process, 34.05 grams of the copolymer of Carrier Example VII, 11.35 grams of a thermosetting polyester/polyurethane polymer (Envirocron PCU10101, obtained from PPG Industries) containing 30 percent by weight of an electrically conductive carbon black (SC Ultra, obtained from Conductex, Inc.) with a particle size of between 4 and 7 microns, and 4,540 grams of 65 micron Hoeganaes core were mixed. The conditions under which the carrier was processed are identical to that of Carrier Example XXX. The final product was comprised of a carrier core with a total of 1.0 percent coating weight polymer of 75 weight percent poly(DIAEMA-co-MMA) (27.1 percent/72.9 percent monomer ratio), 17.5 weight percent crosslinked polyester/polyurethane, and 7.5 weight percent conductive carbon black on the carrier surface.

A developer composition was then prepared in the same manner as Carrier Example I. Thereafter, the triboelectric charge on the carrier particles was determined by the known Faraday Cage process, and there was measured on the carrier a charge of 106.77 microcoulombs per gram. Further, the conductivity of the carrier as determined by forming a 0.1 inch long magnetic brush of the carrier particles, and measuring the conductivity by imposing a 10 volt potential across the brush was 6.18 $E^{-15}$ mho-cm$^{-1}$. Therefore, these carrier particles were insulative.

CARRIER EXAMPLE XXXVIII

In the first step of the carrier coating process, 34.05 grams of the copolymer of Carrier Example VII, 11.35 grams of a thermosetting polyester/polyurethane polymer (Envirocron PCU10101, obtained from PPG Industries) with a particle size of between 4 and 7 microns, and 4,540 grams of 65 micron Hoeganaes core were mixed. The conditions under which the carrier was processed are identical to that of Carrier Example XXX, except that the furnace was maintained at a temperature of 380° F. The final product was comprised of a carrier core with a total of 1.0 percent coating weight polymer consisting of 75 weight percent poly (DIAEMA-co-MMA) (27.1 percent/72.9 percent monomer ratio) and 25 weight percent crosslinked polyester/polyurethane on the carrier surface.

A developer composition was then prepared in the same manner as Carrier Example I. Thereafter, the triboelectric charge on the carrier particles was determined by the known Faraday Cage process, and there was measured on the carrier a charge of 108.59 microcoulombs per gram. Further, the conductivity of the carrier as determined by forming a 0.1 inch long magnetic brush of the carrier particles, and measuring the conductivity by imposing a 10 volt potential across the brush was 2.34 $E^{-15}$ mho-cm$^{-1}$. Therefore, these carrier particles were insulative.

CARRIER EXAMPLE XXXIX

In the first step of the carrier coating process, 45.4 grams of the copolymer of Carrier Example VII and 4,540 grams of 65 micron Hoeganaes core were mixed. The conditions under which the carrier was processed are identical to that of Carrier Example XXX, except that the furnace was maintained at a temperature of 400° F. The final product was comprised of a carrier core with a total of 1.0 percent coating weight polymer of poly(DIAEMA-co-MMA) (27.1 percent/72.9 percent monomer ratio) on the carrier surface.

A developer composition was then prepared in the same manner as Carrier Example I. Thereafter, the triboelectric charge on the carrier particles was determined by the known Faraday Cage process, and there was measured on the carrier a charge of 115.59 microcoulombs per gram. Further, the conductivity of the carrier as determined by forming a 0.1 inch long magnetic brush of the carrier particles, and measuring the conductivity by imposing a 10 volt potential across the brush was 2.54 $E^{-16}$ mho-cm$^{-1}$. Therefore, these carrier particles were insulative.

CARRIER EXAMPLE XL

In the first step of the carrier coating process, 454 grams of the copolymer comprised of 96 percent methylmethacrylate (MMA) and 4 percent diisopropylaminoethylmethacrylate (DIAEMA) generated with a particle size of 0.5 micron prepared via surfactant free emulsion polymerization in Synthetic Example XII and 45.4 kilograms of 65 micron volume median diameter irregular steel core (obtained from Hoeganaes) were mixed. The mixing was accomplished in a Munson Minimixer blender with the following process conditions: blender speed of 17 rotations per minute, a blend time of 20 minutes, and a humidity of 3 millimeters Hg. There resulted uniformly distributed and electrostatically attached, as determined by visual observation, on the carrier core the premixed polymers. Thereafter, the resulting carrier particles were inserted in a continues feed manner into a rotating tube furnace for a period of 35 minutes. This furnace was maintained at a temperature of 400° F. thereby causing the polymers to melt and fuse to the core. The final product was comprised of a carrier core with a total of 1.0 percent coating weight polymer of poly(DIAEMA-co-MMA) (4 percent/96 percent monomer ratio) by weight on the surface.

A developer composition was then prepared in the same manner as Carrier Example I. Thereafter, the triboelectric charge on the carrier particles was determined by the known Faraday Cage process, and there was measured on the carrier a charge of 91.5 microcoulombs per gram. Further, the conductivity of the carrier as determined by forming a 0.1 inch long magnetic brush of the carrier particles, and measuring the conductivity by imposing a 10 volt potential across the brush was about $1\times10^{-14}$ (ohm-cm)$^{-1}$. Therefore, these carrier particles were insulative.

Other modifications of the present invention may occur to those of ordinary skill in the art subsequent to a review of the present application, and these modifications, including equivalents thereof, are intended to be included within the scope of the present invention.

What is claimed is:

1. A carrier comprised of a core and thereover a first polymer coating of (1) a polymer of methylmethacrylate and a monoalkylaminoalkyl methacrylate or (2) a polymer of methylmethacrylate and dialkylaminoalkyl methacrylate, and a second coating comprised of a polyurethane and which polyurethane optionally contains dispersed therein conductive components.

2. A carrier in accordance with claim 1 wherein each of said alkyl independently contains from 1 to about 25 carbon atoms.

3. A carrier in accordance with claim 1 wherein each of said alkyl independently contains from 1 to about 6 carbon atoms.

4. A carrier in accordance with claim 1 wherein said first polymer coating is a copolymer of methylmethacrylate and dimethylaminoethyl methacrylate, or a copolymer of methylmethacrylate and a monoalkylaminoalkyl methacrylate.

5. A carrier in accordance with claim 1 wherein the first polymer coating is a copolymer of methylmethacrylate and a dialkylaminoalkyl methacrylate.

6. A carrier in accordance with claim 5 wherein said copolymer is dimethylaminoethyl methacrylate/methylmethacrylate.

7. A carrier in accordance with claim 5 wherein the copolymer contains from about 60 to 95 weight percent of methylmethacrylate, and from about 5 to 40 weight percent of dialkylaminoalkyl methacrylate.

8. A carrier in accordance with claim 5 wherein the copolymer possesses an $M_w$ of form about 20,000 to about 900,000, and of an $M_n$ of from about 12,000 to about 350,000.

9. A carrier in accordance with claim 1 wherein the first polymer coating is a copolymer and the coating weight thereof is from about 0.1 to about 20 weight percent.

10. A carrier in accordance with claim 1 wherein the first polymer coating weight is from about 1 to about 3 weight percent.

11. A carrier in accordance with claim 1 wherein the first polymer coating contains a conductive component.

12. A carrier in accordance with claim 11 wherein the conductive component is a metal oxide, or is carbon black.

13. A carrier in accordance with claim 12 wherein said conductive component is carbon black selected in an amount of from about 10 to about 60 weight percent.

14. A carrier in accordance with claim 1 wherein said core is a metal, a metal oxide, or a ferrite.

15. A carrier in accordance with claim 1 with a triboelectric charge of from about a positive 50 to about a positive 150 microcoulombs per gram.

16. A carrier in accordance with claim 1 with a triboelectric charge of from about a positive 50 to about a positive 70 microcoulombs per gram.

17. A developer comprised of the carrier of claim 1 and toner.

18. A developer in accordance with claim 17 wherein the toner is comprised of thermoplastic resin and colorant.

19. A developer in accordance with claim 18 wherein the colorant is a pigment and the resin is a styrene copolymer, or a polyester.

20. An imaging process which comprises developing an image with the developer of claim 17.

21. A carrier in accordance with claim 1 wherein said first polymer coating is a copolymer of methylmethacrylate/dimethylaminoethyl methacrylate; a copolymer of methylmethacrylate and tertiary-butylaminoethyl methacrylate; a copolymer of methylmethacrylate and diethylaminoethyl methacrylate; a copolymer of methylmethacrylate and diisopropylaminoethyl methacrylate; or a copolymer of methylmethacrylate and an alkylaminoethyl methacrylate.

22. A carrier in accordance with claim 1 wherein the second coating is comprised of a polyurethane/polyester with carbon black optionally dispersed therein.

23. A carrier in accordance with claim 1 wherein said conductive components are present.

24. A carrier in accordance with claim 23 wherein said conductive components are comprised of carbon black.

25. A developer comprised of a (1) carrier core having a first coating layer of a copolymer or copolymers of methylmethacrylate and a dialkylaminoalkyl methacrylate, and a second coating of a polyurethane and which polyurethane optionally contains dispersed therein conductive components, and (2) a toner.

26. A developer in accordance with claim 25 wherein the carrier core is selected from the group consisting of iron, ferrites, steel and nickel.

27. A developer in accordance with claim 25 with a carrier triboelectric charge of from about a positive 50 to about a positive 150 microcoulombs per gram, and a toner triboelectric charge of from about a negative 50 to about a negative 150 microcoulombs per gram.

28. A developer in accordance with claim 25 with a carrier triboelectric charge of from about a positive 60 to about a positive 70 microcoulombs per gram, and a toner triboelectric charge of from about a negative 60 to about a negative 70 microcoulombs per gram.

29. A carrier consisting essentially of a core and thereover a first polymer coating of (1) a polymer of methylmethacrylate and a monoalkylaminoalkyl methacrylate or (2) a polymer of methylmethacrylate and dialkylaminoalkyl methacrylate, and a second coating comprised of a polyurethane and which polyurethane optionally contains dispersed therein conductive components.

* * * * *